US006454386B1

(12) United States Patent
Premnath et al.

(10) Patent No.: US 6,454,386 B1
(45) Date of Patent: Sep. 24, 2002

(54) CLEANING SYSTEM FOR INK JET PRINT HEADS THAT MAINTAIN INK/CLEANING FLUID CONCENTRATION LEVELS

(75) Inventors: Karai P. Premnath, Rochester, NY (US); Stephen D. Cipolla, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 58 days.

(21) Appl. No.: 09/711,104

(22) Filed: Nov. 14, 2000

(51) Int. Cl.[7] ..... B41J 2/165
(52) U.S. Cl. ..... 347/28
(58) Field of Search ..... 347/28, 36

(56) References Cited

U.S. PATENT DOCUMENTS 4,364,065 A * 12/1982 Yamamori et al. ..... 347/28
5,634,170 A 5/1997 Knapp et al.
5,821,955 A * 10/1998 Waschhauser ..... 347/36
6,168,256 B1 * 1/2001 Sharma et al. ..... 347/28

* cited by examiner

*Primary Examiner*—Lamson Nguyen
*Assistant Examiner*—Shih-Wen Hsieh
(74) *Attorney, Agent, or Firm*—Oliff & Berridge, PLC

(57) ABSTRACT

Methods and systems for maintaining the concentration of cleaning solutions for cleaning print heads at an effective cleaning level throughout the life of a printer in which the print heads are installed include holding the cleaning fluid in one or more holding tanks. Contaminated cleaning solution in each of the one or more holding tanks is maintained at a suitable contamination/clean solution ratio by adding fresh solution and drawing off contaminated solution from one or more of the one or more holding tanks. The cleaning fluid is recirculated to and from one or more print head cleaning chambers and the one or more holding tanks.

28 Claims, 3 Drawing Sheets

CLEANING SYSTEM FOR INK JET PRINT HEADS THAT MAINTAIN INK/CLEANING FLUID CONCENTRATION LEVELS

BACKGROUND OF THE INVENTION

1. Field of Invention

This invention concerns methods and systems for cleaning ink jet print heads.

2. Description of Related Art

Some ink jet printer print heads which use water based inks, such as, for example, acoustic ink jet print heads, are difficult to clean. Ink jet printers that use such difficult-to-clean print heads employ cleaning systems which become soiled over time. These soiled cleaning systems typically have to be replaced at regular intervals. Ink jet printers that use such difficult-to-clean print heads also typically use complex seal mechanisms at the print head-cleaning system interface to prevent cleaning fluid from spilling or otherwise leaking at the interface.

Some cleaning systems use rotating cleaning rollers that dip into cleaning fluid contained in a cleaning chamber. In operation, a squeegee roller bears against the cleaning roller and squeezes out excess cleaning fluid. Then, a rotating cleaning roller bears against the print head to apply cleaning fluid to the soiled print head. The applied cleaning fluid dissolves and washes away dried ink, including dried ink plugs, paper dust and other print head contaminants from the print head orifices into the cleaning fluid in the cleaning chamber, where the dried ink and other contaminants are dissolved into the cleaning fluid contained in the cleaning chamber.

SUMMARY OF THE INVENTION

Problems with ink jet print head cleaning systems include buildup of ink and/or other contaminants in the cleaning fluid with each cleaning cycle, and evaporation of water and other non-volatile liquids from the cleaning solutions during periods of non-use. These problems sharply reduce the useful life of cleaning fluids by increasing the concentration levels of ink in the cleaning fluid.

That is, the concentration ratio of ink to cleaning fluid in the cleaning fluid contained in the cleaning chamber increases as the cleaning fluid is used to clean the print head. As a result, the cleaning fluid becomes less efficient at cleaning the print heads. After a certain number of cleaning cycles, the cleaning fluid resident in the cleaning chamber becomes too contaminated to effectively clean print heads.

This invention provides methods and systems that maintain the concentration of ink in the cleaning fluid throughout the life of the printer at levels where the effectiveness of the cleaning fluid in removing contaminants is not substantially impaired.

This invention separately provides systems and methods that compensate for and/or reduce the evaporation of volatile chemical compounds from the cleaning fluid.

This invention separately provides systems and methods that reduce the build-up of ink and/or other contaminants in the cleaning fluid.

This invention separately provides cleaning systems that reduce the need to use complicated seal mechanisms to contain the cleaning fluid in the cleaning system.

In various exemplary embodiments, one or more of these features are provided by pumping cleaning fluid into the print head cleaning chamber only when one or more of the print heads need to be cleaned. After the print head cleaning operation is completed, the cleaning fluid left in the cleaning chamber is removed from the cleaning chamber and sent to holding tanks, which are closed containers where the cleaning fluids are held to prevent evaporation of volatile materials in the cleaning fluid.

At various intervals, a known amount of contaminated cleaning fluid is removed from one or more of the holding tanks to a leach bed. The leach bed has a capacity to hold waste cleaning fluid bled to it from the holding tanks and is able to evaporate the waste cleaning fluid effectively over the life of the printer. A measured amount of fresh, i.e., uncontaminated, make-up cleaning fluid is then added into the one or more holding tanks from a corresponding cleaning fluid container. This results in maintaining the ink/cleaning fluid concentration in the holding tanks within ranges which result in effective long term cleaning of the print heads, e.g., for the useful life of the printer. This can also compensate for any volatile compounds lost from the usable cleaning fluid due to evaporation.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein.

DETAILED DESCRIPTION OF PREFERRED EMBODIMENTS

Figure 1:
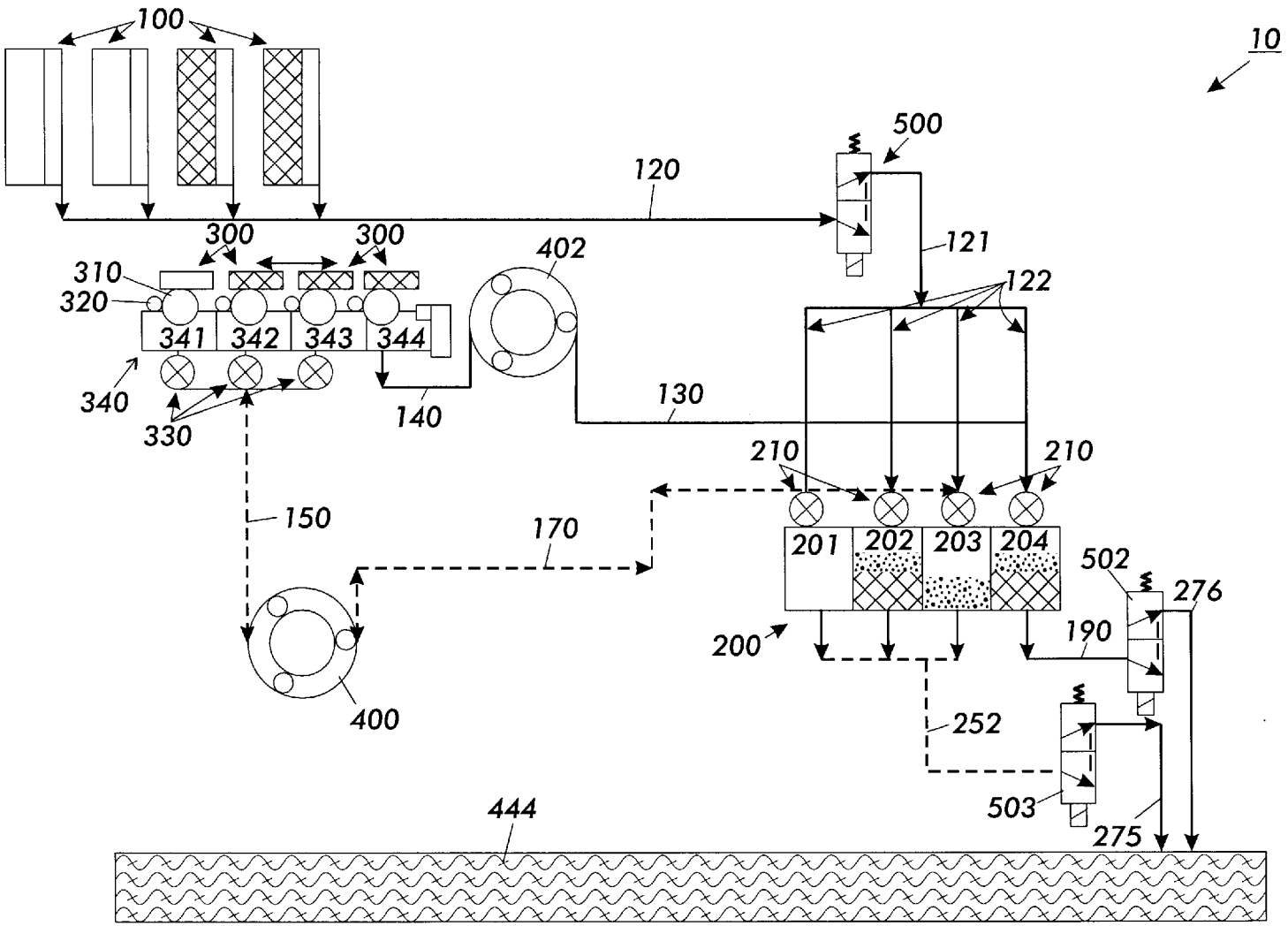
FIG. 1 is a schematic drawing of one embodiment of the ink jet print head cleaning system of this invention.

FIG. 1 shows a cleaning system 10 for an ink jet printer. The ink cleaning system 10 includes a number of ink/cleaning fluid containers 100 that contain both ink to be provided to one or more print heads 300 and fresh, uncontaminated cleaning fluid. Each of the ink/cleaning fluid containers 100 has two chambers, one which holds ink and another which holds cleaning fluid. The ink jet printer is designed so that ink and/or cleaning fluid can be withdrawn from these dual-chambered containers 100.

The dual-chambered containers 100 are fluidly connected by a conduit 120 and valve 500 via a number of conduits 121 and 122 to a multi-compartment holding tank 200. A valve 210 is located in each of the conduits 122. Three adjacent holding tank compartments 201–203 are connected to a bleed line 252, which is connected to a bleed valve 503. The bleed valve 503 is connected to a leach pad 444 via a bleed line 275. One holding tank compartment 204 is connected to a bleed line 190 which is connected to a bleed valve 502. The bleed valve 502 is connected to the leach pad 444 via the bleed line 276. The leach pad 444 is an evaporative waste pad made of an absorbent material such as, for example, felt.

The cleaning system 10 includes a cleaning chamber 340. As shown in FIG. 1, in various exemplary embodiments, cleaning chamber 340 has four separate compartments 341–344. Each compartment 341–344 is associated with one of the four print heads 300. It should be appreciated that, in other exemplary embodiments, there may be more or fewer cleaning chambers 340, chamber compartments 341–344, print heads 300, and/or ink and cleaning fluid containers 100 provided in a particular device. Each cleaning chamber compartment 341–344 contains a cleaning roller 310 and a squeegee roller 320. Each of the cleaning chamber compartments 341–343 are connected to a corresponding pinch valve 330. These three pinch valves 330 are connected through a conduit 150 to a first pump 400, which may be, for example, a peristaltic pump. The first pump 400 is connected through a conduit 170 and the valves 210 to the three holding tanks 201–203. One cleaning chamber compartment 344 is connected through a conduit 140 to a second pump 402, which may, for example, be a peristaltic pump. The second pump 402 is connected through a conduit 130 and one of the conduits 122 and one of the valves 210 to the holding tank compartment 204.

Of the four separate cleaning compartments 341–344 of the cleaning chamber 340, one of the three cleaning compartments 341–343 is provided for each of the three subtractive primary colors, cyan, magenta and yellow. The remaining cleaning compartment 344 is provided for the achromatic color black. In the exemplary embodiment shown in FIG. 1, the peristaltic pump 400 is used for the three chromatic colors, while the other peristaltic pump 402 is used for the achromatic color. However, a pump may be provided, for example, for each individual color, or one pump could be provided to handle all four cleaning compartments 341–344. Moreover, if there were no need for separate cleaning fluids for separate inks, only one holding tank need be provided.

When the print heads 300 need to be cleaned, the peristaltic pumps 400 and 402 are run in a first direction to pump the cleaning fluid from the holding tanks 201–204 to the cleaning chamber compartments 341–344. The holding tank vents are open during this operation. The cleaning rollers 310 pick up the cleaning fluid. The squeegee rollers 320 remove excess cleaning fluid and the squeegeed cleaning rollers 310 then apply the cleaning fluid to the print heads 300 to clean them.

The peristaltic pumps 400 and 402 then pump the used or contaminated cleaning fluid from the cleaning chamber compartments 341–344 to the respective holding tanks 201–204. The holding tank vents are also open during this operation. The holding tank vents are then closed to prevent evaporation of volatiles from the cleaning fluid in the holding tanks 201–204.

One advantage of this cleaning system 10 is that the cleaning system 10 can be made a permanent part of an ink jet printer. Because the cleaning system 10 is a permanent part of the ink jet printer and does not become significantly contaminated, there is no need to replace the cleaning system 10, or parts of the cleaning system 10, over the life of the ink jet printer. One advantage of the dual chamber containers 100 that contain an ink and a cleaning fluid, is that replacing any one or all of the dual chambered ink/cleaning fluid cartridges 100 provides a constant supply of fresh cleaning fluid.

The leach pad 444 is designed to absorb a significant amount of cleaning fluid without overflowing during the portion of the cleaning cycle in which cleaning fluid is bled from one or more holding tanks 201–204 and to release the absorbed amount of cleaning fluid to atmosphere in between cleaning cycles so that by the time a cleaning cycle is resumed, including bleeding cleaning fluid from one or more holding tanks, the leach pad 444 will be able to absorb all of the fluid bled from the one or more holding tanks without overflowing and evaporate the fluid to atmosphere prior to the next cleaning cycle.

Figure 2:
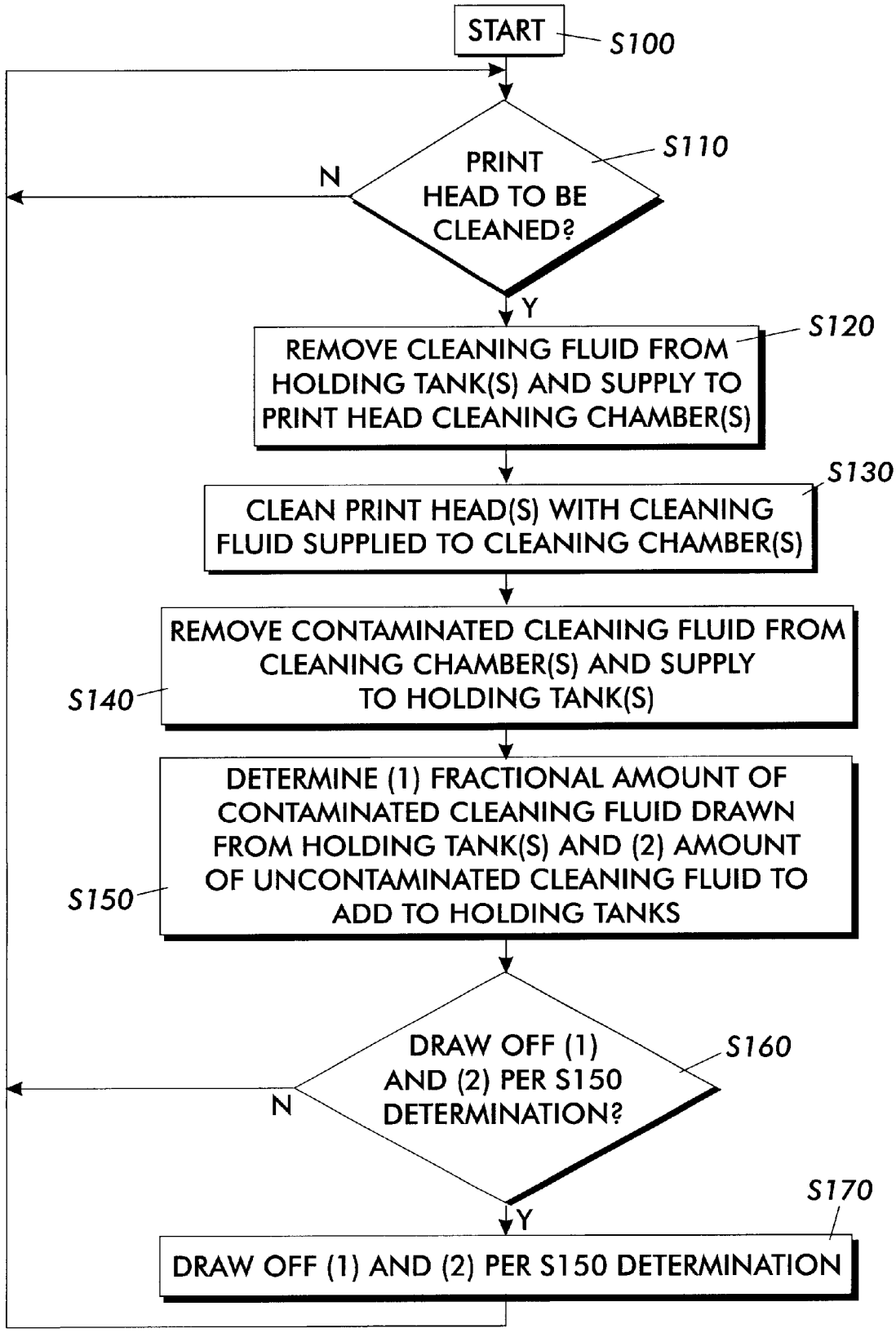
FIG. 2 is an outline of a method for cleaning a print head.

FIG. 2 is a flowchart outlining one exemplary embodiment of a method for cleaning print heads according to this invention. Beginning in step S100, control continues to step 110, where a determination is made of whether one or more print heads need cleaning. If at least one print head needs cleaning, control continues to step S120. Otherwise, if a determination is made that no print head needs cleaning, control returns to step S110.

In step S120, cleaning fluid is moved from one or more holding tanks to a cleaning chamber. Next, in step S130, one or more of the print heads is cleaned using the cleaning fluid in the cleaning chamber. Then, in step S140, the used cleaning fluid is removed from the cleaning chamber and returned to one or more of the holding tanks. Control then continues to step S150.

In step S150, a fractional amount of used cleaning fluid to be drawn from the one or more holding tanks and forwarded to a leach pad is determined. Additionally, in step S150, an amount of fresh, uncontaminated cleaning fluid to be added to the used cleaning fluid in the one or more holding tanks to achieve a cleaning fluid with a contaminant-to-cleaning fluid concentration which will effectively clean the print heads is determined. Then, in step S160, a determination is made whether to draw off or bleed the determined amount of used, contaminated cleaning fluid from the one or more holding tanks, and to add the determined amount of fresh, uncontaminated cleaning fluid to those one or more holding tanks. This determination may be made based on the amount of contamination actually present or estimated to be present in the contaminated cleaning fluid, the capacity of the leach pad, the amount of uncontaminated cleaning fluid available, and/or the cost-effectiveness of reconstituting the cleaning fluid each cycle or every other cycle, or every third cycle, etc. If, in step S160, the fractional amount of contaminated fluid is to is drawn off, control continues to step S170. Otherwise, control jumps back to step S110. In step S170, the determined fractional amount of contaminated cleaning fluid is drawn from the holding tank to the leach pad and the determined amount of uncontaminated fluid is added to the holding tanks. Control then returns to step S110.

The determination of the amount of used, contaminated cleaning fluid to be bled from one or more holding tanks, and of the amount of fresh, uncontaminated cleaning fluid to be added to one or more holding tanks, may be accomplished in several ways. In one illustrative method, an empirical method is used. In order to determine how much contaminated cleaning fluid to remove and how much fresh cleaning fluid to add in this illustrative method, tests are run to determine how much ink can be in the cleaning solution and still have the cleaning solution effectively clean the print heads. If the cleaning solution is simply recycled without adding any additional cleaning solution, a point is reached where the ink contaminated cleaning solution can no longer effectively clean the print heads. Once that point is reached, a sample of the ink contaminated cleaning solution can be transferred from the cleaning container to the holding tank and then purged from the holding tank into a container. The optical density of the ink contaminated cleaning solution can be compared with the optical density of one or more cleaning solutions with various amounts of ink added to those cleaning solutions. When the optical density of the sample drawn from the printer matches that of the cleaning solution with a known amount of ink contamination, the amount of ink contamination which renders the cleaning solution ineffective is known. In this manner, or in similar manners, one can determine how much cleaning solution to add to the recycled cleaning solution to maintain a recycled cleaning solution with contaminants at an ink-to-cleaning solution ratio which will continue to effectively clean print heads. Adding cleaning solution to the recycled ink contaminated cleaning solution is accomplished in the holding tanks.

For example, in one exemplary embodiment of the systems and methods according to this invention, if it is determined that, on average, a print head cleaning cycle results in addition of ink and other contaminants which constitute 5% by volume of the cleaning solution, and no degradation in print head cleaning effectiveness occurs until those contaminants constitute 15% or more by volume of the cleaning solution, a fractional portion of the contaminated cleaning solution, for example, 5% by volume of contaminated cleaning fluid, may be removed from the holding tank, and a similar amount of fresh cleaning solution added every other cleaning cycle. Alternatively, for example, 2.5% by volume of contaminated cleaning fluid may be removed every cleaning cycle from the holding tank, and a corresponding amount of fresh cleaning solution added. In another exemplary embodiment, the optical density of the recycled cleaning fluid, e.g., in the holding tanks, can be monitored. When the monitored optical density reaches a certain value, which indicates that the contaminants are approaching 15% by volume of the recycled cleaning fluid, then a suitable fractional amount of the contaminated cleaning solution could be removed from the holding tanks or any other suitable location in the system and/or a suitable amount of fresh cleaning fluid added to reduce the contaminated cleaning solution to an optical density which was known to result in effective print head cleaning. Care must be taken, however, so that the amount of fluid bled from the one or more holding tanks is within the capacity of the leach pad to absorb without overflowing, and which can be evaporated before more cleaning fluid is bled to the leach pad from the one or more holding tanks which could cause overflowing of the cleaning fluid from the leach pad.

As a result of such tests, Applicants have found that if the amount of ink which is cleaned from the print head and which enters the cleaning fluid is up to 15% by volume of the cleaning fluid, no observable reduction in the ability of the cleaning solution to adequately clean the print head occurs. If the amount of ink which is cleaned from the print head and which enters the cleaning fluid is between 15% and 30% of the volume of the cleaning fluid, only a slight reduction in the ability of the cleaning fluid to adequately clean the print head occurs. However, if the amount of ink cleaned from the print head and which enters the cleaning fluid is above 30% by volume, the ability of the cleaning solution to adequately clean the print head begins to be significantly reduced.

As indicated above, the systems and methods according to this invention attempt to maintain a desired concentration of ink to cleaning fluid in the cleaning chamber to achieve effective print head cleaning. After the print head cleaning operation is completed, the cleaning fluid left in the cleaning chamber is removed from the cleaning chamber and sent to holding tanks, which are closed containers where the cleaning fluids are held to prevent evaporation of volatile materials in the cleaning fluid.

Applicants have found that, in various exemplary embodiments of the ink jet purging head cleaning systems and methods according to this invention, purging about 2.5% by volume of the used cleaning solution returned from the cleaning container to the holding tank and into the leach bed 444, and adding fresh cleaning solution in an amount of about 4% by volume of the amount of used cleaning solution returned from the cleaning container to the holding tank results in maintaining the contaminant to cleaning solution ratio of cleaning solution below 10% on a long term basis, such as, for example, over 2500 cleaning cycles. This is considered to maintain the ink/cleaning fluid concentration within a range which results in effective cleaning of print heads over the average life of an ink jet printer.

In a second illustrative embodiment, step S150 may involve the use of a real time sensor, which can be used to make an actual measurement of the degree of contamination of the cleaning solution.

Figure 3:
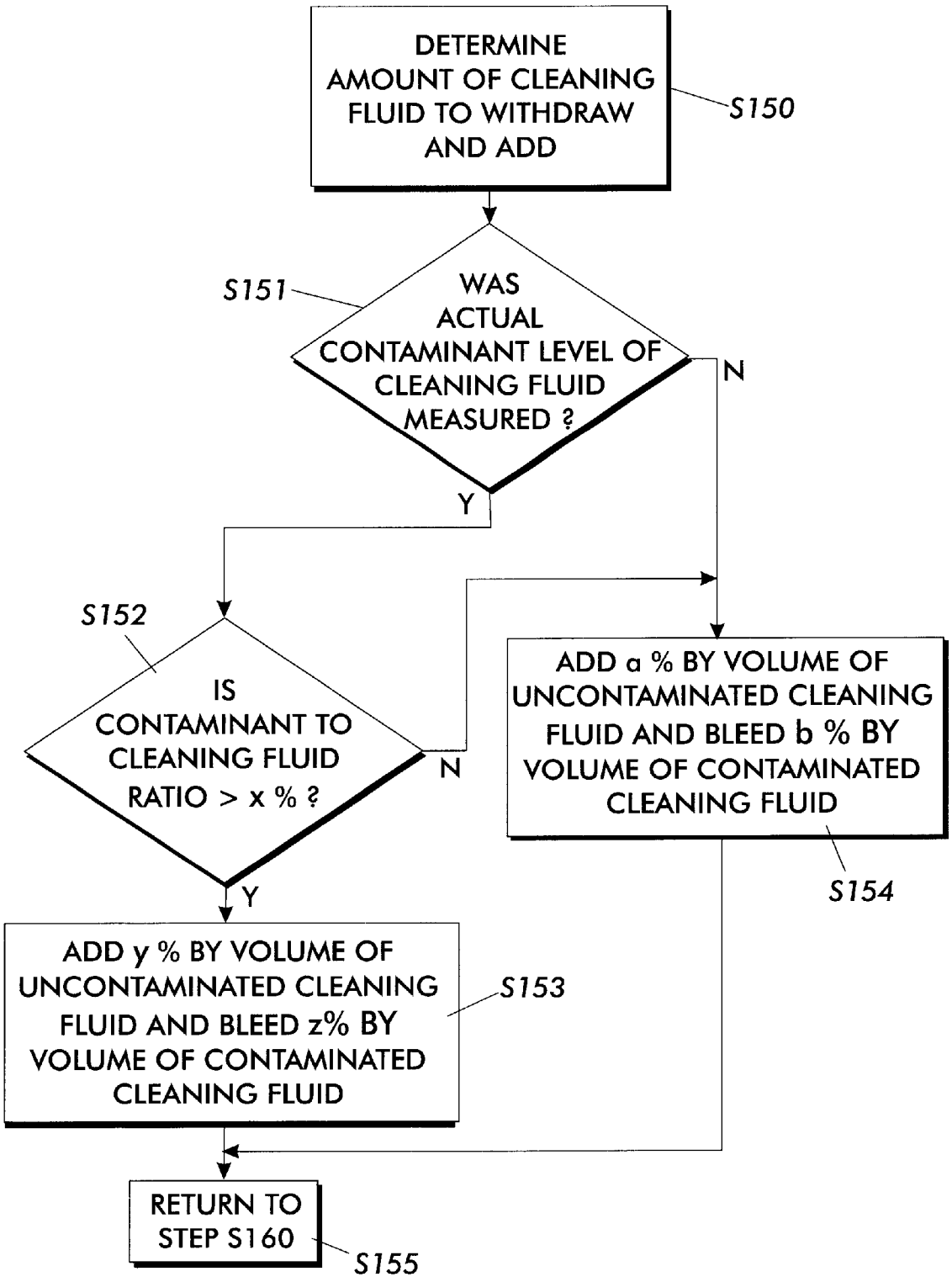
FIG. 3 is a flowchart outlining in greater detail one exemplary embodiment of one step of the method of FIG. 2.

FIG. 3 shows in greater detail one exemplary embodiment of a method for making the determinations of step S150. As indicated above, in step S150, a determination of (1) the fractional amount of contaminated cleaning fluid to be drawn from the holding tank(s) and (2) the amount of uncontaminated cleaning fluid to add to the holding tank(s) is made. Thus, beginning in step S150, control continues to step S151, where a determination is made whether an actual measurement was made of the contaminant level of the cleaning fluid. If such a measurement was not made, control jumps to step S154. Otherwise, control continues to step S152.

In step S152, a determination is made whether the contaminant to cleaning fluid ratio is above a certain level, such as, for example, above x% by volume, where x is an empirically determined value. If the contaminant level is not above x% by volume, then control jumps to step S154. Otherwise, control moves to step S153.

In step S153, a determination is made to add y% by volume, where y is an empirically determined value, of uncontaminated cleaning fluid to, and draw off z% by volume, where z is an empirically determined value, of contaminated cleaning fluid from, one or more of the holding tanks. Control then passes to step S155.

In contrast, in step S154, a determination is made based on empirical data to add a% by volume, where a is an empirically determined value, of uncontaminated cleaning fluid to, and to bleed b% by volume, where b is an empirically determined value, of contaminated fluid from, one or more of the holding tanks. As indicated above, in various exemplary embodiments, b% was empirically determined to be about 2.5% by volume and a% was empirically determined to be about 4% by volume. Control then continues to step S155, which returns control to step S160.

When making an actual determination of the contaminant concentration, a sensor (not shown) may be placed anywhere in the system from, and including, the cleaning chamber to the holding tanks. The sensor may be, for example, an optical absorption detector or an electrical impedance detector, or an acoustic detector. The output from the sensor is compared with values obtained from a look-up table, for example, to determine how much used cleaning fluid to be drawn off and how much fresh cleaning fluid to be added to the used cleaning fluid to maintain a contaminant to cleaning fluid concentration ratio which will result in effective cleaning of the print heads.

If an actual, real time, determination of the contaminant concentration of the used cleaning fluid is not used, an empirical approach may be used. In this illustrative embodiment, the amount of used cleaning fluid to be drawn off and the amount of fresh cleaning fluid to be added to keep the contaminant to cleaning fluid ratio in an acceptable range over the expected life of the printer to achieve effective print head cleaning is determined on a trial-and-error basis, as outlined above. These amounts can remain unchanged throughout the life of the printer or may be adjusted by a user should print head cleaning not be acceptable.

One example of a cleaning solution used with this invention is de-ionized water which contains a small amount of co-solvent, such as, for example, N-methyl-Pyrrolidinone and trace bio-cide, such as, for example, sodium omadine or Dowicil®.

Because the cleaning chamber 340, which houses the cleaning rollers 310, is not discarded or changed over the life of the printer, and there is no cleaning fluid circulating when the cleaning system 10 is not in use, there is little danger of spilling cleaning solution. Consequently, there is no need for complex sealing mechanisms at the interface of the cleaning rollers 310 and the print heads 300.

The capacity of each holding tank is larger than the capacity of each cleaning chamber, so that regardless of the amount of fresh cleaning fluid added to the contaminated cleaning fluid, the holding tanks have sufficient capacity to add enough fresh cleaning fluid to maintain the concentration of ink to cleaning fluid at a level where the effectiveness of the cleaning fluid in removing contaminants from the print head is not significantly impaired.

The size and composition of the leach bed 444 may vary depending on the capacity of cleaning fluid which is desired to be bled from the holding tanks at a given time, and on the ability of the leach bed to rapidly evaporate that fluid. In one exemplary embodiment, the leach bed is a container made of polypropylene of a rectangular shape with a capacity to hold at least 100 ml of waste fluid at any given moment without dripping. The absorbent material is Nomex® felt, but may be made of any suitable woven or non-woven material, natural or synthetic. The size of the absorbent pad is at least 1200 cc and is capable of absorbing and holding 1000 ml of water without overflowing.

The amount of contaminated cleaning fluid withdrawn from the cleaning system, which is bled out into the leach bed 444 for evaporation, and the amount of fresh cleaning fluid to be added to the cleaning system may be controlled by conventional microprocessor control based either on dynamic real time input from a device which measures a suitable cleaning fluid parameter, such as, for example, optical density, electrical impedance or acoustic absorption.

While this invention has been described in conjunction with the exemplary embodiments set forth above, it is evident that many alternatives, modifications and variations will be apparent to one of ordinary skill in the art. Accordingly, the exemplary embodiments of the invention set forth above in intended to be illustrative and not limiting. Various changes may be made without departing from the spirit and scope of the invention.

What is claimed is:

1. A method of cleaning an ink jet print head comprising:

storing cleaning fluid in at least one storage device until a cleaning operation is to be performed;

when the cleaning operation is to be performed, moving the cleaning fluid from at least one of the at least one storage device to at least one cleaning container;

applying cleaning fluid from the at least one cleaning container to at least one ink jet print head to clean the at least one print head, the cleaning fluid washing contaminants into the cleaning fluid in the at least one container;

moving the contaminated cleaning fluid to at least one of the at least one storage devices; and determining the ratio of the level of contaminants to cleaning fluid in the contaminated cleaning fluid.

2. The method of claim 1, further comprising maintaining the concentration of contaminants to cleaning fluid in contaminated ink at most at one or more levels where the effectiveness of the cleaning fluid in removing contaminants from at least one print head is not impaired.

3. The method of claim 2, wherein maintaining the concentration of contaminants to cleaning fluid includes:

comparing a current ratio of contaminants to cleaning fluid in the cleaning fluid in the at least one storage device to a ratio which will effectively clean a print head; and reconstituting the cleaning fluid in the at least one storage device with fresh cleaning fluid based on the comparison.

4. The method of claim 3, wherein reconstituting the cleaning fluid comprises supplying fresh cleaning fluid to the at least one storage device.

5. The method of claim 3, wherein reconstituting the cleaning fluid comprises drawing off an amount of contaminated cleaning fluid from the at least one storage device.

6. A method of cleaning an ink jet print head comprising:

storing cleaning fluid in at least one storage device until a cleaning operation is to be performed;

when the cleaning operation is to be performed, moving the cleaning fluid from at least one of the at least one storage device to at least one cleaning container;

applying cleaning fluid from the at least one cleaning container to at least one ink jet print head to clean the at least one print head, the cleaning fluid washing contaminants into the cleaning fluid in the at least one container;

moving the contaminated cleaning fluid to at least one of the at least one storage devices; and reconstituting the cleaning fluid in the at least one storage device with fresh cleaning fluid.

7. The method of claim 6, wherein reconstituting the cleaning fluid comprises drawing off an amount of contaminated cleaning fluid from the at least one storage device.

8. The method according to claim 7, further comprising:

absorbing the drawn off amount of contaminated cleaning fluid in a leach pad; and evaporating the drawn off contaminated cleaning fluid from the leach pad.

9. The method of claim 6, wherein reconstituting the cleaning fluid comprises adding an amount of uncontaminated cleaning fluid to the at least one storage device.

10. The method of claim 9, wherein the cleaning fluid is supplied from a dual chambered container.

11. The method of claim 6, wherein reconstituting the cleaning fluid comprises:

supplying fresh cleaning fluid to the at least one storage device; and drawing off an amount of contaminated cleaning fluid from the at least one storage device.

12. A system usable to clean at least one print head of an ink jet printer, comprising:

at least one cleaning container;

a cleaning mechanism that uses cleaning fluid contained in at least one of the at least one cleaning container to wash contaminants from at least one of the at least one print head into the cleaning fluid in the corresponding at least one cleaning container;

at least one storage device, each storage device usable to store the cleaning fluid and any contaminants in the cleaning fluid; and a contaminant ratio determining apparatus usable to determine a ratio of the level of contaminants to cleaning fluid in contaminated cleaning fluid.

13. The system of claim 12, further comprising:

at least one pump, each pump moving the cleaning fluid to at least one of the at least one storage device from at least one of the at least one cleaning container after a cleaning operation and moving cleaning fluid from at least one of the at least one storage device to at least one of the at least one cleaning container prior to a cleaning operation; and an apparatus usable to reconstitute the cleaning fluid in at least one holding tank with fresh cleaning fluid to maintain a selected ratio of contaminants to cleaning fluid in the at least one storage device.

14. The system of claim 13, wherein the reconstituting apparatus supplies fresh cleaning fluid to the at least one storage device.

15. The system of claim 13, wherein the reconstituting apparatus draws off an amount of contaminated cleaning fluid from the at least one storage device.

16. The system of claim 15, further comprising an absorber to absorb contaminated cleaning fluid drawn from the at least one storage device.

17. The system of claim 15, wherein the absorber comprises an absorbent pad.

18. The system of claim 17, wherein the absorbent pad is a felt pad.

19. The system of claim 12, further comprising a source of cleaning fluid.

20. The system of claim 19, wherein the source of cleaning fluid is a dual chambered container.

21. The system of claim 12, wherein the at least one storage device has a plurality of compartments.

22. The system of claim 21, wherein the at least one storage device comprises four compartments.

23. The system of claim 12, wherein the cleaning container comprises a plurality of cleaning compartments.

24. The system of claim 23, wherein the plurality of cleaning compartments is four.

25. A method of cleaning an ink jet print head comprising:

storing cleaning fluid in at least one storage device until a cleaning operation is to be performed;

moving, when the cleaning operation is to be performed, the cleaning fluid from at least one of the at least one storage device to at least one cleaning container;

applying cleaning fluid from the at least one cleaning container to at least one ink jet print head to clean the at least one print head, the cleaning fluid washing contaminants into the cleaning fluid in the at least one container;

moving the contaminated cleaning fluid to at least one of the at least one storage devices;

determining a fractional amount of contaminated fluid to draw from at least one of the at least one storage device; and determining an amount of uncontaminated cleaning fluid to add to at least one of the at least one storage device.

26. The method of claim 25, further comprising drawing off the determined fractional amount of contaminated fluid and adding the determined amount of uncontaminated cleaning fluid that at least one of to the at least one storage device.

27. A method of cleaning an ink jet print head using a fluid cleaning system, comprising:

determining an amount of cleaning fluid to add to and withdraw from the fluid cleaning system;

determining a contaminant-to-cleaning-fluid ratio;

adding an amount of uncontaminated cleaning fluid to the fluid cleaning system based on the determined contaminant-to-cleaning-fluid ratio.

28. The method according to claim 27, further comprising bleeding an amount of contaminated fluid from the fluid cleaning system based on the determined contaminant-to-cleaning-fluid ratio.

* * * * *